US005708935A

United States Patent [19]

Rabjohns

[11] Patent Number: 5,708,935

[45] Date of Patent: Jan. 13, 1998

[54] SIMPLIFIED AUTOMATED DUPLEX MARGIN REPOSITIONING SYSTEM FOR DIFFERENT SIZE ORIGINALS

[75] Inventor: Douglas T. Rabjohns, Fairport, N.Y.

[73] Assignee: Xerox Corporation, Stamford, Conn.

[21] Appl. No.: 786,468

[22] Filed: Jan. 21, 1997

[51] Int. Cl.[6] ..... G03G 21/00

[52] U.S. Cl. ..... 399/193; 399/370; 399/374; 399/401

[58] Field of Search ..... 399/182, 193, 399/370, 374, 401

[56] References Cited

U.S. PATENT DOCUMENTS

| | | | |
|---|---|---|---|
| 4,162,844 | 7/1979 | Traister et al. | 399/193 |
| 4,187,024 | 2/1980 | Satomi et al. | 399/193 |
| 4,456,372 | 6/1984 | Yamauchi | 399/370 X |
| 4,611,908 | 9/1986 | Buch | 399/83 X |
| 4,745,441 | 5/1988 | Maruta et al. | 399/193 |
| 4,819,029 | 4/1989 | Ito | 399/193 |
| 4,941,017 | 7/1990 | Mishima et al. | 399/193 |
| 5,398,289 | 3/1995 | Rourke et al. | 382/1 |
| 5,461,469 | 10/1995 | Farrell et al. | 399/407 |
| 5,541,713 | 7/1996 | Takatsuki et al. | 399/376 |

FOREIGN PATENT DOCUMENTS

| | | |
|---|---|---|
| /62-116432 | 5/1987 | Japan . |
| /62-283349 | 12/1987 | Japan . |

*Primary Examiner*—Nestor Ramirez

[57] ABSTRACT

A simplified automated process for printing duplex copy sheets with correct edge margins from first and second original documents having a different dimension than the copy sets so that the duplex copy sheets will have substantially equal margins from the image areas on both sides of the duplex copy sheets irrespective of these different sheet sizes, including measuring at least one dimension of an original document sheet and automatically subtracting the known size dimension of the selected copy sheets in the dimension which includes the margin from the corresponding dimension of the original document sheet to determine a desired duplex image shift dimension, and shifting the image printed on second side of the copy sheet from the second original document by a distance corresponding to the calculated shift to produce duplex copy sheets with substantially equal margins.

4 Claims, 4 Drawing Sheets

SIMPLIFIED AUTOMATED DUPLEX MARGIN REPOSITIONING SYSTEM FOR DIFFERENT SIZE ORIGINALS

Disclosed is a simplified automated process for producing duplex printed copy sheets of a selected and known copy sheet size with correct edge margins from first and second original document sheets having a different dimension than the copy sets, so that said duplex copy sheets will have substantially equal margins from the image areas in at least one margin in one dimension on both sides of the duplex copy sheets irrespective of the different sheet size of the original document sheets, including measuring at least one dimension of an original document sheet and automatically subtracting the known size dimension of the selected copy sheets in the dimension which includes the margin from the corresponding dimension of the original document sheet to determine a desired duplex image shift dimension, and operating the duplex reproduction apparatus control system to shift the image printed on second side of the copy sheet from the second original document by a distance corresponding to the calculated duplex image shift dimension to produce duplex copy sheets with substantially equal margins from the image areas on both sides of the duplex copy sheets in at least one dimension irrespective of the different sheet sizes of the original documents from the copy sheets.

There is extensive patent literature on automatic margin shifting of the second side of duplex prints. In conventional or light-lens copiers, this includes Xerox Corp. U.S. Pat. No. 4,162,844 issued Jul. 31, 1979 to Traister et al; Ricoh U.S. Pat. No. 4,187,024 issued Feb. 5, 1980 to T. Satomi, et al; and Minolta U.S. Pat. No. 4,819,029 issued Apr. 4, 1989 to H. Ito. In electronic printing, electronic image shifting for signatures duplex printing for proper edge trimming is disclosed for example in Xerox Corp. U.S. Pat. No. 5,398, 289 issued Mar. 14, 1995 to Rourke et al, and U.S. Pat. No. 5,461,469. Eastman Kodak U.S. Pat. No. 4,611,908 issued Sep. 16, 1986 to D. C. Buch discloses duplex electronic printer margin area control and selection.

There is also patent literature on various systems for detecting the size of an original document, including doing so while the document is on the document imaging platen, e.g., U.S. Pat. Nos. 5,541,713; 4,456,372; EP 0 270 884; etc. In digital electronic document scanning systems it is well known to electronically detect the document sheet edges in a pre-scan or imaging scan, to detect the document sheet size, especially if the document is under a non-white or UV reflective platen cover or transport belt providing a contrasting or differently light reflective imaging background to the document.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or single chip VLSI designs.

It is well known that the control of document and copy sheet handling systems may be accomplished by conventionally actuating them with signals from a microprocessor controller directly or indirectly in response to simple programmed commands, and/or from selected actuation or non-actuation of conventional switch inputs such as switches selecting the number of copies to be made in that job or run, selecting simplex or duplex copying, selecting a copy sheet supply tray, etc. The resultant controller signals may conventionally actuate various conventional electrical solenoid or cam-controlled sheet deflector fingers, motors or clutches, or other components, in programmed steps or sequences. Conventional sheet path sensors or switches connected to the controller may be utilized for sensing, counting, and timing the positions of sheets in the sheet paths of the reproduction apparatus, and thereby also controlling the operation of sheet feeders and inverters, etc., as is well known in the art.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "simplex" document or copy sheet is one having its image and any page number on only one side or face of the sheet, whereas a "duplex" document or copy sheet has "pages", and normally images, on both sides, i.e., each duplex sheet is considered to have two opposing sides or "pages" even though no physical page number may be present. Documents may be called "originals" even if they were themselves copies.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of a specific embodiment, including the drawing figures (approximately to scale), wherein:

Figure 1:
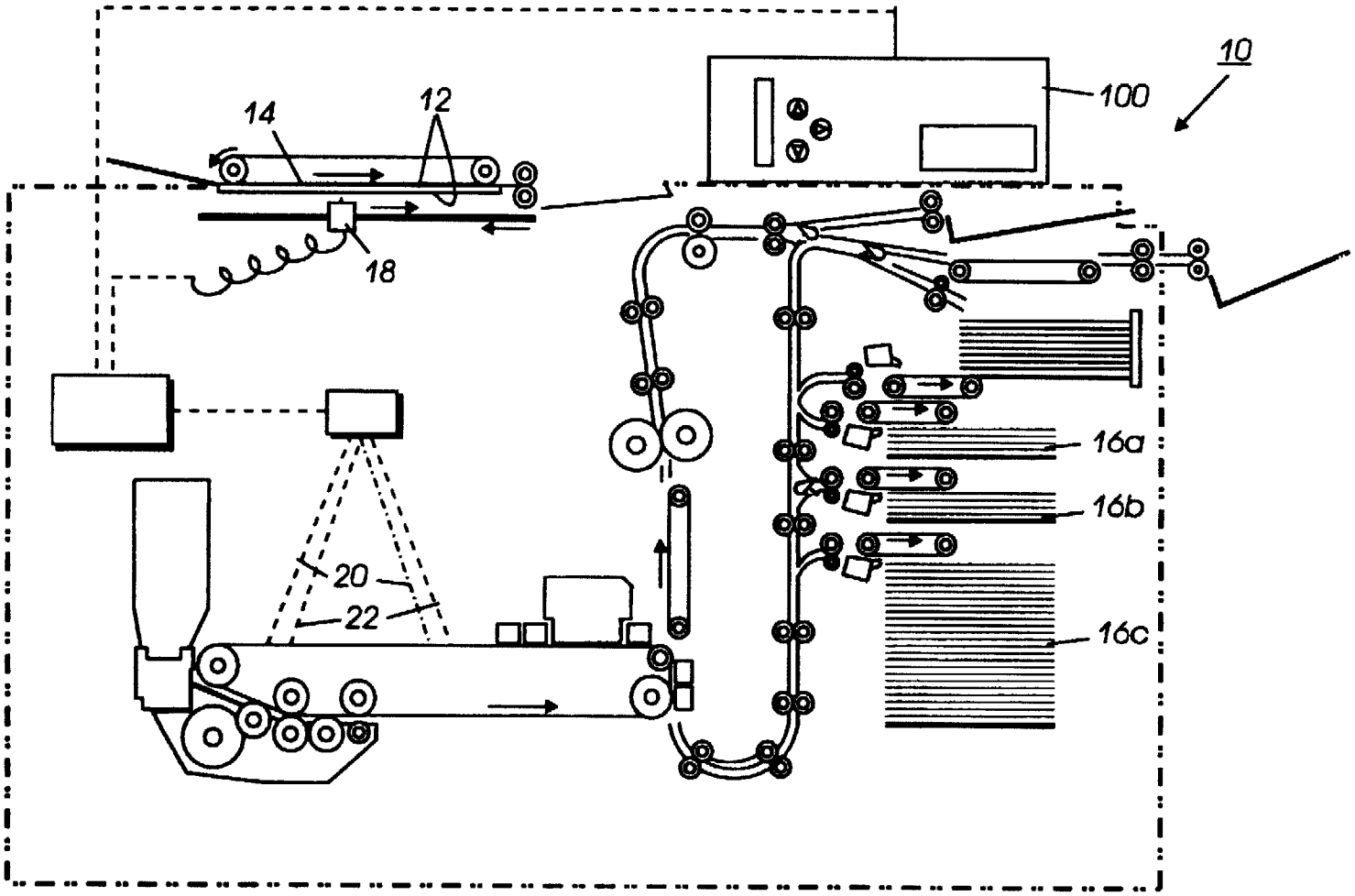
FIG. 1 is a schematic, side view of a conventional exemplary duplex optical or electronic copier or printer with which the present system can be utilized, schematically illustrating one example of a conventional image shifting system, with image shifting illustrated by the shifting from the dashed line to the phantom line positions.
Figure 2:
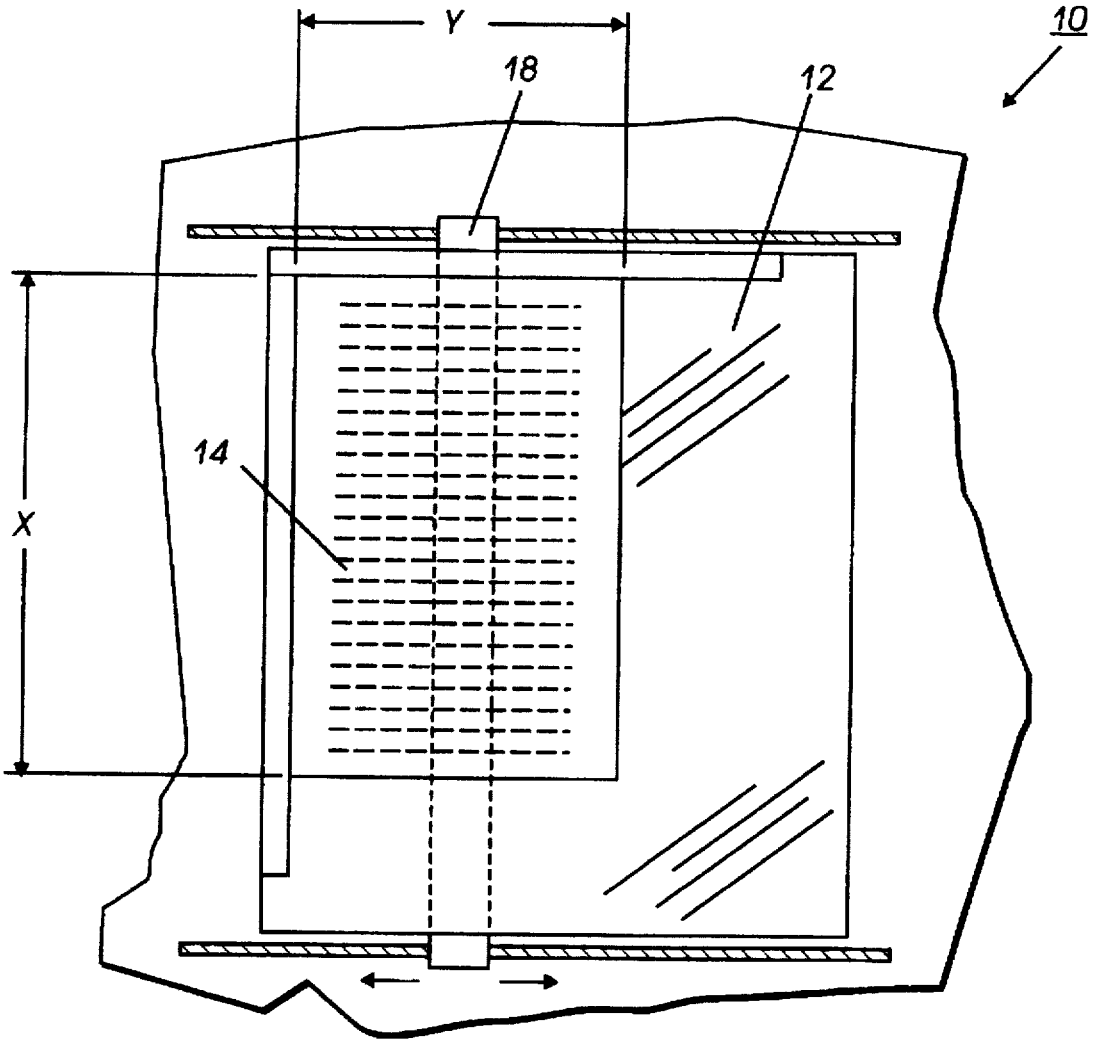
FIG. 2 is a partial top view of the imaging platen area of the copier of FIG. 1 showing a document being registered thereon in two dimensions and scanned by an optical scanner, shown schematically in phantom, moving under the imaging platen to measure the document dimension, as shown by the phantom movement arrow.

Referring to the Figs., there is shown in FIGS. 1 and 2 one example of a duplex reproduction apparatus or machine, in this example an electronic printer/copier 10 with a conventional software programmable microprocessor controller 100 and document imaging platen 12 on which documents 14 may be placed, or automatically fed, to be registered and copied, here by a scanner 18. This is normally a two-axes document 14 registration on the platen 12, as shown in FIG. 2.

By way of background on the disclosed simplified margin correction or control process, where duplex (two sided) copies are desired on selected copy sheets 15 of one standard size, but at least one of the originals 14 to be copied is of a different size, it is known that using a standard fixed registration position for the documents can result in misregistration of the margin space outside the reproduced image area on the copies, especially duplex copy opposing sides, and that can cause particular problems if plural such duplex copies are to be bound as a book or pamphlet on that margin edge with insufficient margins, which can interfere with reading of the image extending into the binding margin or gutter of the bound copy set, or cause the opposite edge of the image to be partially cut off in conventional book edge trimming used to even up the unbound edge of the book.

Note that the subject process is actuated only in response to the machine 10 selection of duplex copying, the machine 10 selection of copy sheets of a known dimension, and the detection of an original document sheet different in at least one dimension from a dimension of said selected copy sheets. Typically, as is well known, the selection of duplex copying and copy sheet size is by automatic default selections thereof in machine 10 controller 100 non-volatile memory, or by independent or overriding operator interface switch or display panel selections.

Typically, copy paper size is known in the machine 10 controller 100 memory by selection of one or more of a particular machine 10 paper feeding drawer **16*a*, 16*b*, 16*c*, or a cassette, into which paper of particular size is nominally loaded. However, it is also known to provide electronic sheet measurements, such as from the position of the tray side guides or the timing of the copy sheet passage at a constant speed past a sensor in the sheet path. Likewise, as is known from the above cited and other art, it is known in electronic imaging in particular to use the under-platen electronic image scanner, such as 18** here, to also measure the dimensions of the document being imaged, as it is scanned. Other document dimension measurement systems are also known.

Figure 5:
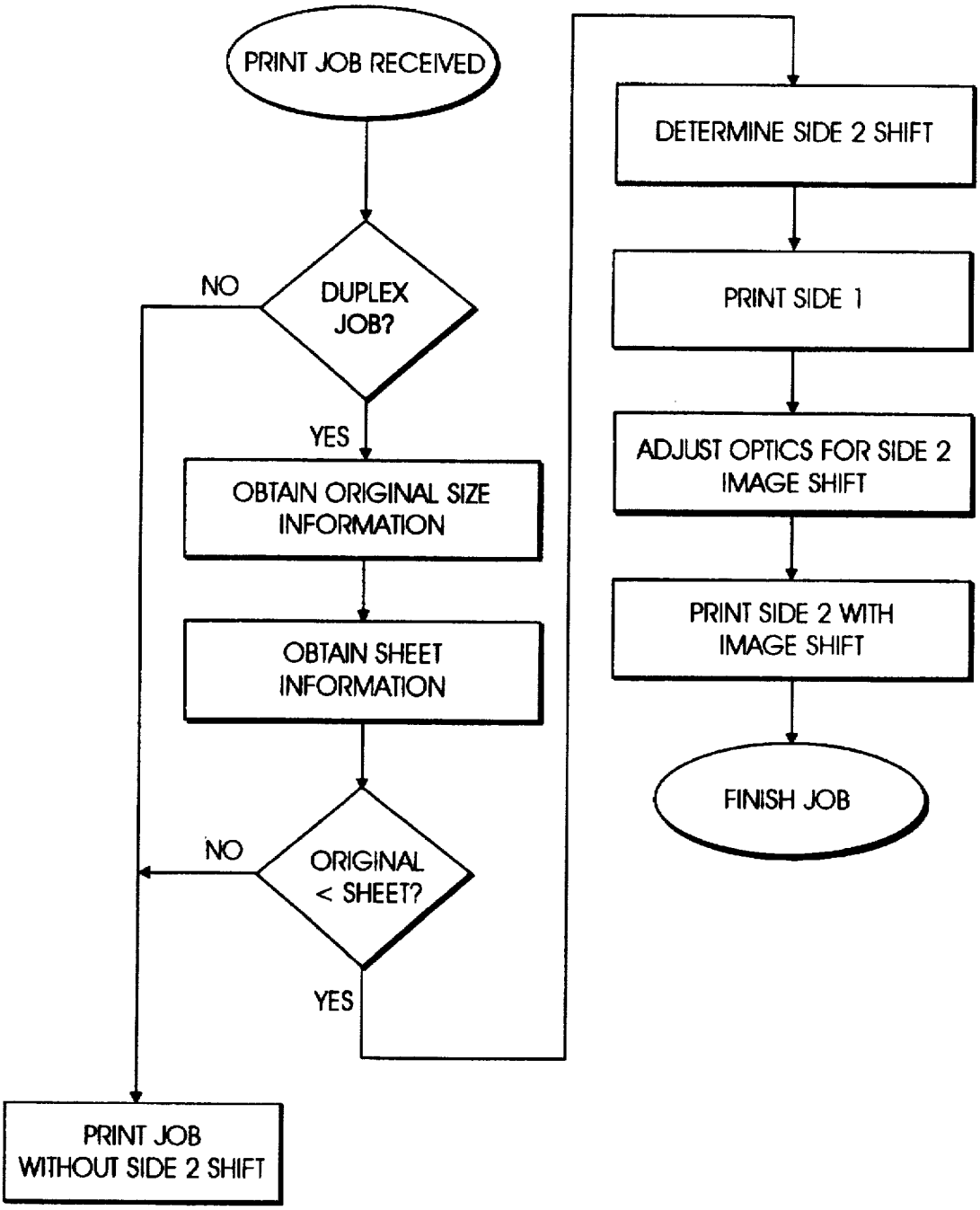
FIG. 5 is an exemplary flow chart of the subject exemplary process.

Merely as one example of the exemplary system, besides the descriptions above, there is provided the flow chart of FIG. 5. FIG. 5 has legends thereon which will be self explanatory to those skilled in the art.

Figure 3:
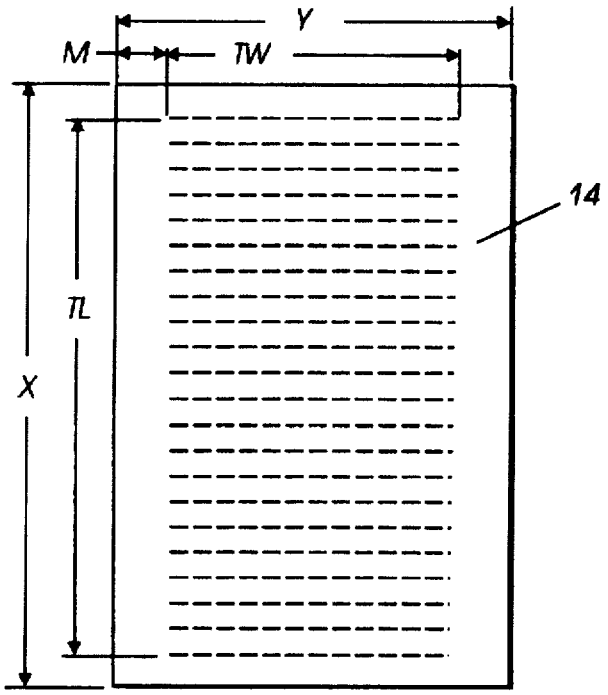
FIG. 3 illustrates a document sheet with an image area which is being copied onto the second side of a copy sheet of a different dimension (shown in FIG. 4)
Figure 4:
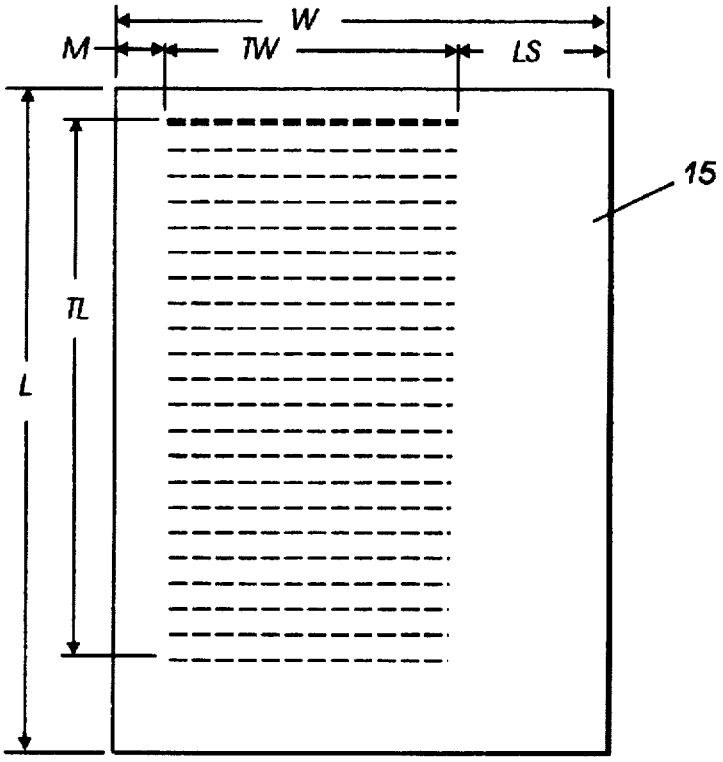
FIG. 4 illustrates the second side of the copy sheet onto which the image of the document sheet of FIG. 3 is being copied, with a shifted, corrected, image margin.

FIGS. 2 and 3 show an example of a document 14 of one size being copied onto the second side of a copy sheet 15 of a different, larger, size of FIG. 4, with an automatically corrected or shifted left side image margin "M" on the copy sheet 15 so as to have the same left side margin "M" as the original document 14. In these drawings, "TW" is the text or image width, "TL" is the text or image length. On the original document 14 of FIGS. 2 and 3, "Y" is the document width and "X" is the document length. On the copy sheet 15 of FIG. 4, "W" is the copy sheet 15 width, "L" is the sheet 15 length, and "LS" is the left shift distance to maintain the same second side image margin "M" on this larger sheet 15.

To further verbalize another specific example, take a situation in which the operator of a duplex copier desires to optically image a set of original documents of a 7" by 10" dimensions size, but wants these originals to be duplex copied onto standard U.S. letter size paper (8.5" by 11" dimensions), to be normally bound on the left hand side, i.e., with the left hand sides of the sheets commonly aligned, superposed and bound, by binding tape, or otherwise. Assume it is further desired to do normal edge trimming of the bound set at a common trimming edge thereof which opposite from the binding edge. The problem is that most copiers provide process direction registration of the copy sheets during their printing from their lead edges. That is the same registration edge as the registration edge for the original being imaged for the printing of the first side of a copy sheet. But when a copy sheet is duplexed, that copy sheet is inverted before the second side is printed, and thus its trail edge now in effect becomes its lead edge for its second side printing of the second document image. In this example, that would cause the 7" original images to justify left rather than right on the second sides of the duplex copies, and if these duplex copies are bound and trimmed (cut off) on the right edges there would be no trim margin and part of the image on the second side of each duplex sheet could be cut off. Thus it is desired to provide a side margin for the second sides of the duplex copy sheets which is appropriate for the trimming edge. Preferably, providing the same, equal, trimming margin (in portrait printing mode) on both sides (both pages) of each duplex copy sheet, without having to use different document registration positions for the original document pages being imaged. Since the known selected copy paper source dimension for the side margins is 8.5", that may be subtracted in the machine controller 100 by the corresponding measured 7" sheet dimension of the original document to derive a 1.5" automatic image shift signal for the printer to move the second side image in the process direction by 1.5", so as to provide a second side right margin equal to the right margin on the first side of the duplex copy sheet.

FIG. 1 illustrates one example of an image shifting system in the exemplary reproduction machine 10, with image shifting by the controller in accordance with the above described calculation for the selected page image illustrated here by the shifting of the image staff and stop positions from the dashed lines 20 positions to the phantom line positions 22 on the photoreceptor on which the latent image is being formed for that page image, in a known manner, e.g., by slightly shifting the optical path, or changing the laser beam "write" times relative to the photoreceptor movement, etc. Another known alternative is to shift the feed or pre-transfer registration timing of the copy sheet and thus shift the copy sheet position relative to the developed latent image it is about to receive thereon in the image transfer station.

As another example, using the subject process for landscape mode printing in the process direction, with a known selected copy paper source dimension for the top margin of 11", that may be subtracted in the machine controller from the corresponding (long side) measured 10" sheet dimension of the original document in the above example to derive a 1" automatic image shift signal for the printer to move the second side image by 1" so as to provide a second side top margin equal to the top margin on the first side.

While the embodiment disclosed herein is preferred, it will be appreciated from this teaching that various alternatives, modifications, variations or improvements therein may be made by those skilled in the art, which are intended to be encompassed by the following claims:

I claim:

1. A simplified automated process for producing duplex printed copy sheets of a selected two dimensional sheet size from original document sheets of a two dimensional sheet size with at least one dimension of said document sheets which is different from said copy sheets, so that said duplex copy sheets will have substantially equal margins from the image areas in at least one margin in one dimension on both sides of the duplex copy sheets irrespective of said different sheet size of said original document sheets from said copy sheets, which original document sheets are imaged at a two axes registration position on the imaging platen of an imager for input to a duplex reproduction apparatus for printing said duplex copy sheets on opposing sides with images of two said document sheets, which duplex reproduction system also includes a control system for image position shifting of the image printed on said copy sheets, and for storing information as to the known size dimensions of the selected said copy sheets; said automated process further comprising:

registering a first original document sheet of a first sheet size at said two axes registration position on said imaging platen for said imaging thereof, removing said first original document sheet of said first sheet size from said imaging platen after said imaging, registering a second original document sheet at said same two axes registration position on said imaging platen in the same orientation as said first original document sheet for said imaging thereof, measuring at least one dimension of at least one of said first or second original document sheets to automatically determine at least one said dimension of its sheet size, automatically subtracting said known size dimension of said selected copy sheets in the dimension which includes said margin from the corresponding said dimension of said original document sheet to determine a desired duplex image shift dimension, and operating said duplex reproduction apparatus control system for image position shifting of the image printed on said copy sheets to shift said image of said second original document sheet on said copy sheet by a distance corresponding to said duplex image shift dimension to produce said duplex copy sheets with substantially equal margins from the image areas on both sides of the duplex copy sheets in at least one said dimension irrespective of said different sheet sizes of said original document sheets from said copy sheets.

2. The automated process of claim 1, wherein said copy sheets are bound in superposed sets of sheets at a binding edge which is the copy sheets printing registration edge and which bound sets are trimmed at a common trimming edge thereof opposite from said binding edge, and wherein said margin is the side margin of said duplex copy sheets which is at said common trimming edge.

3. The automated process of claim 1, further including;

electronically scanning both said first and second original document sheets to automatically determine both of their sheet sizes, if said second document sheet size is equal to said first document sheet size, proceeding with said above process, and if said second document sheet size is not equal to said first sheet size, not proceeding with said above process, and instead providing a machine display effectively warning that said margins of said duplex copy sheets may not be commonly aligned.

4. The automated process of claim 1, wherein said process is actuated only in response to a machine selection of duplex copying, a machine selection of copy sheets of a known dimension, and the detection of a said original document sheet different in at least one dimension from a dimension of said selected copy sheets.

* * * * *